US005185076A

United States Patent [19]

Yanada et al.

[11] Patent Number: 5,185,076

[45] Date of Patent: Feb. 9, 1993

[54] BATH AND METHOD FOR ELECTRODEPOSITING TIN, LEAD AND TIN-LEAD ALLOY

[75] Inventors: Isamu Yanada; Tooru Murakami; Kiyoshi Asakawa, all of Hirakata, Japan

[73] Assignee: C. Uyemura & Co., Ltd., Osaka, Japan

[21] Appl. No.: 684,321

[22] Filed: Apr. 12, 1991

[30] Foreign Application Priority Data

May 7, 1990 [JP] Japan ..... 2-117078

[51] Int. Cl.[5] ..... C25D 3/60

[52] U.S. Cl. ..... 205/252; 205/253; 106/1.12

[58] Field of Search ..... 205/252, 253, 254, 299, 205/300, 301; 106/1.12

[56] References Cited

U.S. PATENT DOCUMENTS

| | | | |
|---|---|---|---|
| 3,887,444 | 6/1975 | Fueki et al. | 205/253 |
| 3,984,291 | 10/1976 | Lerner et al. | 205/252 |
| 4,329,207 | 5/1982 | Maruta | 205/301 |
| 4,946,748 | 8/1990 | Higuchi et al. | 205/252 |

*Primary Examiner*—John Niebling
*Assistant Examiner*—Brian M. Bolam
*Attorney, Agent, or Firm*—Birch, Stewart, Kolasch & Birch

[57] ABSTRACT

A bath for electrodepositing tin, lead or an alloy thereof, containing a tin and/or lead ion and a sulfate ion becomes stable at pH 1 or higher when a condensed phosphate ion is added thereto. The bath is effective for depositing tin-lead alloy films on sealing glass-metal integrated articles.

4 Claims, No Drawings

BATH AND METHOD FOR ELECTRODEPOSITING TIN, LEAD AND TIN-LEAD ALLOY

This invention relates to a bath and method for electrodepositing tin, lead or tin-lead alloy on articles, typically sealing glass-metal integrated articles.

BACKGROUND OF THE INVENTION

Conventional well-known tin, lead or their alloy plating baths include sulfuric acid baths, alkane sulfonic acid baths, alkanol sulfonic acid baths, borofluoric acid baths, and phenol sulfonic acid baths. They are widely used for plating various electric and electronic parts.

Problems arise when alkane sulfonic, alkanol sulfonic, borofluoric, and phenol sulfonic acid baths are used for plating glass-metal integrated articles containing low-melting sealing glass such as CERDIP and C-QFP type IC packages encapsulated with low-melting glass. These baths can erode the low-melting sealing glass and deposit coatings of tin and solder (tin-lead alloy) on the sealing glass regions with attendant bridging. Like these acidic baths, neutral baths will also erode sealing glass and deposit coatings thereon.

In turn, sulfuric acid baths are advantageous for electrodeposition on glass-metal integrated articles containing low-melting sealing glass because they little erode the sealing glass or deposit coatings thereon. The sulfuric acid bath is applicable to tin plating as a tin sulfate bath, but not to solder plating. Better solder plating is not expected simply by adding lead sulfate to a conventional sulfuric acid bath. It is thus difficult to provide better solder plating to sealing glass-metal integrated articles such as CERDIP and C-QFP type IC packages encapsulated with low-melting glass. Instead of the solder coatings, tin coatings are formed using tin sulfate plating baths. The tin coatings, however, suffer from whisker formation which will cause short circuiting when applied to electric and electronic parts.

In addition, all the sulfuric acid and other baths mentioned above are strong acid baths and have problems in that they can attack the plating apparatus and articles to be plated and in that they generate a strong acid mist during operation, resulting in an undesirable working environment.

There is a need for a plating bath which can plate satisfactory tin, lead, and solder coatings on glass-metal integrated articles containing sealing glass while minimizing corrosion of the plating apparatus and maintaining an acceptable working environment.

SUMMARY OF THE INVENTION

The inventors have found that this need can be met by adding a condensed phosphate ion to a plating bath containing a tin and/or lead ion and a sulfate ion. The resulting bath is stable at pH 1 or higher. When the bath is used for plating on glass-metal integrated articles containing sealing glass, the sealing glass which is typically lead glass, is not eroded, and no coating deposits on the sealing glass region while satisfactory tin and lead coatings deposit on the metal region. Where a tin-lead alloy is plated in the co-presence of tin and lead ions, the problem associated with a conventional sulfuric acid bath free of a condensed phosphate ion, that no satisfactory tin-lead alloy plating is achieved because of the co-presence of tin and lead ions causing lead to precipitate rather than being dissolved, is eliminated by the newly formulated bath as defined herein because the addition of a condensed phosphate ion renders lead soluble so that satisfactory tin-lead alloy coatings may be deposited. In addition, by varying the proportion of tin and lead ions, a tin-lead alloy coating having a corresponding composition can be deposited. Since the bath may be adjusted to pH 1 or higher, there are obtained several benefits, including minimized attach on the plating apparatus and decreased maintenance of the working environment, compared to the conventional strong acid baths.

The reason why a sulfate ion is effective for plating on sealing glass-metal integrated articles is not well understood. While the invention is not bound to the theory, it is presumed that $SO_4^{2-}$ reacts with $Pb^{2+}$ in sealing glass to form an insoluble $PbSO_4$ film which prevents attack to the underlying sealing glass.

Therefore, the present invention provides a bath for electrodepositing tin, lead or an alloy thereof, containing a tin and/or lead ion, a sulfate ion, and a condensed phosphate ion. The bath is adjusted to pH 1 or higher.

Also, the present invention provides a method for electrodepositing tin, lead or an alloy thereof on an article, comprising the step of effecting electrodeposition on the article in the above-defined bath. The article is typically a sealing glass-metal integrated one.

DESCRIPTION OF THE PREFERRED EMBODIMENTS

The bath of the present invention contains at least one metal ion selected from tin and lead ions. The tin ion may be either bivalent or tetravalent, with the bivalent tin (or stannous) ion being preferred.

The sources for tin and lead ions include tin and lead compounds, for example, such as tin and lead sulfates, tin and lead alkane sulfonates, tin and lead alkanol sulfonates, tin and lead phenolsulfonates, tin and lead oxides, and lead carbonate. Preferred sources are tin sulfate, stannous oxide, lead sulfate, lead oxide, lead carbonate, and lead alkane sulfonates.

The metal ion is preferably present in a concentration of 1 to 120 grams/liter, more preferably 5 to 60 grams/liter. For tin-lead alloy plating, the bath preferably contains 1 to 100 grams/liter, more preferably 4 to 35 grams/liter of a tin ion and 1 to 80 grams/liter, more preferably 1 to 20 grams/liter of a lead ion. By varying the proportion of tin and lead ions, there can be deposited tin-lead alloy coatings having any desired alloying ratio, for example, a tin-to-lead ratio of 95:5, 9:1, 8:2, 7:3, 6:4 and 1:9.

The plating bath of the invention also contains a sulfate ion, a condensed phosphate ion, and optionally, another anion, for example, such as alkane sulfonate ions, alkanol sulfonate ions, phenol sulfonate ions, and sulfamate ions.

These anions impart conductivity to the bath. The concentration of sulfate ion is preferably from 10 to 200 grams/liter, more preferably from 10 to 100 grams/liter. Where another anion is added, the concentration of the other anion ranges from 0 to 100 grams/liter, especially from 0 to 50 grams/liter. For plating on sealing glass-metal integrated articles, the concentration of the other anion should be less than 1/10 of the sulfate ion concentration for minimizing attack and deposition on the sealing glass. The anion is desirably used in a concentration of at least equimolar, especially at least 2 mol, more preferably 2 to 20 mol per mol of the metal ion (tin and lead ions).

Cations which form counter ions to the sulfate ion and other anions include $Sn^{2+}$, $Sn^{4+}$, $Pb^{2+}$, $Na^+$, $K^+$, $Li^+$, $NH_{4+}$, $Mg^{2+}$, and $Al^{3+}$. Among these cations, $Sn^{2+}$, $Sn^{4+}$, and Pb2+ are the metal ion sources at the same time. The amount of $Sn^{2+}$, $Sn^{4+}$ or $Pb^{2+}$should preferably be less than the anion amount, more preferably H should be such that at least 2 mol of the anion is present per mol of the total amount of these cations. In this condition, the counter ion to the remaining anion is preferably $Na^+$, $K^+$, $Li^+$, $NH_4^+$, $Mg^{2+}$ or $Al^{3+}$.

The plating bath of the invention contains a condensed phosphate ion as described above. The condensed phosphate ion is effective as a complexing agent for the metal ion (tin and lead ions). Although the addition of lead sulfate to a conventional tin sulfate bath does not ensure acceptable tin-lead alloy plating as previously mentioned, the co-presence of a condensed phosphate ion allows for acceptable tin-lead alloy plating.

The condensed phosphate ion is supplied as condensed phosphoric acids or salts thereof. Examples of the condensed phosphoric acid include pyrophosphoric acid, tripolyphosphoric acid, tetrapolyphosphoric acid, polyphosphoric acid, metaphosphoric acid, hexametaphosphoric acid, ultraphosphoric acid. Also useful are salts of these phosphoric acids with counter ions such as $Sn^{2+}$, $Sn^{4+}$, $Pb^{2+}$, $Na^+$, $K^+$, $Li^+$, $NH_4^+$, $Mg^{2+}$, and $Al^{3+}$. Also in this case, $Sn^{2+}$, $Sn^{4+}$, and $Pb^{2+}$ are the metal ion sources at the same time. The condensed phosphate ion is desirably used in at least an equimolar concentration, especially in a concentration of at least 1.5 mol per mol of the metal ion ($Sn^{2+}$, $Sn^{4+}$ and $Pb^{2+}$). Where the counter ion to the condensed phosphate ion is $Sn^{2+}$, $Sn^{4+}$ or $Pb^{2+}$, it is desired to add an additional condensed phosphate ion countered with another cation. More particularly, the condensed phosphate ion is preferably used in a concentration of 5 to 400 grams/liter, more preferably 10 to 200 grams/liter.

If necessary, any desired additives may be added to the plating bath of the invention. Useful are agents for making deposits fine, such as polyethylene glycol, pluronic type surface active agents, nonionic surface active agents such as alkyl amine-ethylene oxide adducts, and cationic surface active agents, and brighteners such as aldehydes. Also, pyrocatechol, hydroquinone, resorcin, ascorbic acid may be added for preventing oxidation of $Sn^{2+}$. These additives are added in an effective amount.

The plating bath of the invention is adjusted to pH 1 to 10, preferably pH 1 to 7, more preferably pH 1 to 4, most preferably pH 1.5 to 4. A pH value of lower than 1 is undesirable especially for plating of lead and tin-lead alloy because $Pb^{2+}$ becomes less soluble and because of the inherent disadvantages of such a strong acid bath. Since an extremely high pH value will sometimes lead to current efficiency losses, it is preferred for current efficiency to employ the bath under an acidic condition of pH 4 or lower.

The bath of the invention is effective for electrodepositing tin, lead, and tin-lead alloy. The bath does not attack sealing glass or deposit coatings on sealing glass regions, thus leaving no bridge between plated regions. Therefore, the bath is suitable for plating tin, lead, especially tin-lead alloy films on sealing glass-metal integrated articles, for example, glass-encapsulated CERDIP and QFP type IC packages, chip capacitors, and chip resistors. It is also useful for plating on other electronic metal parts and printed circuit boards.

Any suitable plating process may be selected depending on a particular article to be plated. Rack plating and barrel plating may be employed and even high speed plating is permissible if the flow rate of the plating solution is increased. The cathodic current density may be selected in the range of from 0.01 to 100 $A/dm^2$ depending on a plating process, degree of agitation, and the shape of an article to be plated. Most often, the cathodic current density is from 0.1 to 5 $A/dm^2$. The power supply may be of the single-phase half-wave, single-phase full-wave, three-phase half-wave, three-phase full-wave, complete direct current, pulse current or the like since plating is little affected by the current waveform. The plating temperature may range from 0° C. to 90° C., most often from 10° C. to 60° C. Agitation may be done by well-known liquid agitating techniques, for example, cathode rocking, pumping, jet flow, and barrel rotation as often employed in barrel plating. The anode can be a soluble electrode of the same metal as the plating metal. An insoluble anode of carbon or platinum may also be used if necessary.

In carrying out electrodeposition using the plating bath of the invention, the cathodic current efficiency is about 60 to 99% and the anodic current efficiency is about 90 to 100%.

According to the invention, a variety of articles can be plated with tin, lead or tin-lead alloys. The articles may be pre-treated in conventional well-known ways prior to plating in the bath of the invention. For example, low-melting sealing glass-encapsulated articles having leads of 42 alloy or Kovar® thermally bonded thereto are pretreated with hot sulfuric acid for activating the leads.

There has been described a plating bath capable of electrodepositing films of tin, lead and tin-lead alloys having varying alloying ratio on a sealing glass-metal integrated article without eroding the sealing glass or forming a film on the sealing glass region. In addition, the bath is stable at pH 1 or higher and causes reduced attack to the plating apparatus and articles to be plated compared to the conventional strong acid baths. Minimized generation of strong acid mist in a working atmosphere provides an improved operating condition.

Since the majority of the anion used is a sulfate ion, COD and BOD loads as imposed by organic sulfonic acids and sulfamic acids can be omitted or reduced in amount, also contributing to the environmental maintenance. Also, the bath becomes less expensive.

EXAMPLE

Examples of the present invention are given below by way of illustration and not by way of limitation.

EXAMPLE 1

Low-melting glass encapsulated CERDIP and C-QFP type IC packages were plated with solder using the following plating bath under the following conditions.

| Bath | |
|---|---|
| Sodium sulfate | 100 grams/liter |
| Stannous sulfate | 50 grams/liter |
| Lead sulfate | 10 grams/liter |
| Polyphosphoric acid | 50 grams/liter |
| Surface active agent (tallow amine having ethylene oxide added thereto) | 1 grams/liter |
| Pyrocatechol | 2 grams/liter |

-continued

| | |
|---|---|
| pH (adjusted with aqueous ammonia): 2.0 | |
| Conditions | |
| Cathodic current density: 4 A/dm$^2$ | |
| Agitation: cathode rocking (4 m/min.) | |
| Temperature: 30° C. | |
| Anode: Sn:Pb = 9:1 | |

No metal deposited on the glass regions. The insulation resistance between leads was measured to have a predetermined value. The leads had desirable solder wettability. The solder plating was satisfactory as plating on such packages.

EXAMPLE 2

Plating was repeated by the same procedure as in Example 1 except that the following bath was used. The results were equivalent to Example 1.

| Bath | |
|---|---|
| Ammonium sulfate | 100 grams/liter |
| Stannous methanesulfonate | 50 grams/liter |
| Lead carbonate | 10 grams/liter |
| Sodium pyrophosphate | 100 grams/liter |
| Nonyl phenol-ethylene oxide adduct | 1 grams/liter |
| Hydroquinone | 1 grams/liter |
| pH (adjusted with sulfuric acid): 2.5 | |

EXAMPLE 3

Plating was repeated by the same procedure as in Example 1 except that the following bath was used. The results were equivalent to Example 1.

| Bath | |
|---|---|
| Ammonium sulfate | 75 grams/liter |
| Stannous sulfate | 40 grams/liter |
| Lead sulfate | 20 grams/liter |
| Sodium tripolyphosphate | 75 grams/liter |
| Adekanol PC-13 (Asahi Denka K.K.) | 1 grams/liter |
| Benzaldehyde | 0.1 grams/liter |
| pH (adjusted with aqueous ammonia): 4.0 | |

EXAMPLE 4

Plating was repeated by the same procedure as in Example 1 except that the following bath was used. The results were equivalent to Example 1.

| Bath | |
|---|---|
| Potassium sulfate | 50 grams/liter |
| Stannous sulfate | 30 grams/liter |
| Lead carbonate | 30 grams/liter |
| Sodium tetrapolyphosphate | 30 grams/liter |
| Laurylamine-ethylene oxide adduct | 1 grams/liter |
| Benzalacetone | 0.05 grams/liter |

-continued

| | |
|---|---|
| pH: 7 | |

EXAMPLE 5

Plating was repeated by the same procedure as in Example 1 except that the following bath was used. The results were equivalent to Example 1.

| Bath | |
|---|---|
| Sodium sulfate | 50 grams/liter |
| Stannic sulfate | 30 grams/liter |
| Hexametaphosphoric acid | 20 grams/liter |
| Adekanol PC-13 (Asahi Denka K.K.) | 2 grams/liter |
| pH (adjusted with sulfuric acid): 2.5 | |

EXAMPLE 6

Instead of the IC packages, chip capacitors were plated by a barrel plating technique and copper plates were plated by a rack plating technique, both using the plating baths of Examples 1 to 5. Satisfactory films having improved solder wettability were deposited.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A bath for electrodepositing tin-lead alloy comprising:

tin and lead ions in concentrations of 1 to 100 grams/liter and 1 to 80 grams/liter, respectively, a sulfate ion in a concentration of 10 to 200 grams/liter, and a condensed phosphate ion selected from the group consisting of pyrophosphoric acid, tripolyphosphoric acid, tetrapolyphosphoric acid, polyphosphoric acid, metaphosphoric acid, hexametaphosphoric acid, ultraphosphoric acid and salts thereof in a concentration of 5 to 400 grams/liter, the bath being adjusted to pH 1 to 4.

2. A method for electrodepositing tin lead alloy on an article, comprising the step of:

effecting electrodeposition on the article in a bath as set forth in claim 1.

3. The method of claim 2 wherein the article is a sealing glass-meal integrated article.

4. The method of claim 2, wherein said electrodeposition occurs in the presence of an insoluble anode.

* * * * *